US008671901B2

(12) United States Patent
Suwa et al.

(10) Patent No.: US 8,671,901 B2
(45) Date of Patent: Mar. 18, 2014

(54) EXCESS DEMAND VOLTAGE RELIEF SPARK PLUG FOR VEHICLE IGNITION SYSTEM

(75) Inventors: Yujiro Suwa, Commerce Township, MI (US); Ronald M. Wozniak, Auburn Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 931 days.

(21) Appl. No.: 12/627,176

(22) Filed: Nov. 30, 2009

(65) Prior Publication Data

US 2011/0126789 A1 Jun. 2, 2011

(51) Int. Cl.
*H01T 13/02* (2006.01)
*H01T 13/20* (2006.01)

(52) U.S. Cl.
USPC ..... 123/169 R; 313/137

(58) Field of Classification Search
USPC ..... 123/169 R, 146.5 R, 169 EL, 169 E, 123/169 P, 143 B, 630; 313/137
See application file for complete search history.

(56) References Cited

U.S. PATENT DOCUMENTS

| | | | | | |
|---|---|---|---|---|---|
| 2,564,764 | A | * | 8/1951 | Kovac | 315/91 |
| 4,181,114 | A | | 1/1980 | Carlsson et al. | |
| 4,460,847 | A | * | 7/1984 | Englehardt | 315/58 |
| 4,476,412 | A | * | 10/1984 | Nishida et al. | 313/130 |
| 4,568,855 | A | * | 2/1986 | Nemeth et al. | 315/59 |
| 4,746,834 | A | * | 5/1988 | Bauerle et al. | 313/137 |
| 4,798,991 | A | * | 1/1989 | Benedikt et al. | 313/137 |
| 4,870,319 | A | * | 9/1989 | Benedikt et al. | 313/137 |

FOREIGN PATENT DOCUMENTS

| | | | | | |
|---|---|---|---|---|---|
| CN | 1832280 | A | | 9/2006 | |
| DE | 3206787 | A1 | | 2/1983 | |
| EP | 1701418 | B1 | | 8/2001 | |
| EP | 1202411 | A1 | * | 5/2002 | |
| EP | 2066155 | A2 | | 3/2009 | |
| JP | 2002246144 | A | * | 8/2002 | H01T 13/38 |

* cited by examiner

*Primary Examiner* — Mahmoud Gimie
*Assistant Examiner* — David Hamaoui
(74) *Attorney, Agent, or Firm* — Quinn Law Group, PLLC

(57) ABSTRACT

A vehicle ignition system is provided that alleviates the problems associated with excessive voltage demand by spark plugs. The ignition system has a spark plug with an electrode and a voltage relief feature operatively connected with the electrode. The voltage relief feature is operable to discharge current from the electrode at a predetermined voltage.

5 Claims, 4 Drawing Sheets

EXCESS DEMAND VOLTAGE RELIEF SPARK PLUG FOR VEHICLE IGNITION SYSTEM

TECHNICAL FIELD

The invention relates to a vehicle ignition system with spark plugs configured to relieve excess demand voltage.

BACKGROUND OF THE INVENTION

Spark plugs generally have a center electrode connected with an ignition system as well as a side electrode spaced from the center electrode to establish a gap. The center electrode is surrounded by a ceramic insulator. When voltage generated by the ignition coil causes electrons to flow to the center electrode, a voltage difference develops between the center and the side electrode. The air and gasses in the gap act as an insulator, preventing voltage flow from the center electrode to the side electrode until the voltage exceeds the dielectric strength of the gasses in the gap, allowing electrons to flow across the gap, causing the gasses to react with each other to burn. The voltage at which electrons flow across the gap is referred to as the demand voltage.

If an insulating object, such as water, oil or debris, is in the gap or covers the electrode or counter electrode at the gap, the demand voltage increases. The demand voltage may go up so high as to exceed the dielectric strength of the ceramic insulator, causing it to chip. Ceramic chips may scratch the cylinder bore and allow oil to escape past the piston rings, causing excessive oil consumption.

SUMMARY OF THE INVENTION

A vehicle ignition system is provided that alleviates the problems associated with excessive voltage demand by spark plugs. The ignition system has a spark plug with an electrode and a voltage relief feature operatively connected with the electrode. The voltage relief feature is operable to discharge current from the electrode at a predetermined voltage.

In one embodiment, the voltage relief feature is a varistor configured to discharge current when voltage in the center electrode reaches a predetermined voltage that is less than the dielectric strength of the ceramic insulator around the center electrode. The varistor may be positioned in the ceramic insulator, in the ignition coil, or in the spark plug wire between the ignition coil and the spark plug.

In another embodiment, the voltage relief feature is a thinned portion of the insulator. The thinned portion may completely or only partially circumscribe the electrode. The thinned portion acts to localize and control the area at which the insulator will break in response to excessive demand voltage. When the insulator breaks, the voltage is discharged from the center electrode at the broken thinned portion to a metal casing surrounding the insulator that acts as a ground electrode. The thinned portion is encased in the metal casing and surrounded by the remaining (unbroken) portion of the insulator; thus, no ceramic chips escape from the spark plug. By controlling the thickness of the thinned portion, the voltage at which discharge will occur is controlled.

In still another embodiment, the voltage relief feature is a portion of the ceramic insulator that has ceramic properties of a dielectric strength lower than the dielectric strength of the remainder of the insulator. Thus, voltage discharge will occur at the voltage relief feature. By controlling the dielectric strength, the voltage at which discharge will occur is controlled to a level that will avoid ceramic failure of the remainder of the insulator. The voltage relief feature portion of the ceramic insulator is surrounded by the remaining portion of the insulator and the metal casing. Thus, if the insulator breaks at the voltage relief feature, as designed, no ceramic chips escape from the spark plug, thereby preventing associated engine damage and oil consumption.

By preventing ceramic debris due to excessive demand voltage, the ignition system protects the structural integrity of the spark plug ceramic and reduces oil consumption. The various embodiments of the voltage relief features are all structurally based solutions to the excess demand voltage problem. No change is required to the controller. A more expensive, software control system with feedback of voltage at the spark plug to prevent excess voltage demand is not required. In fact, no software changes are required.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
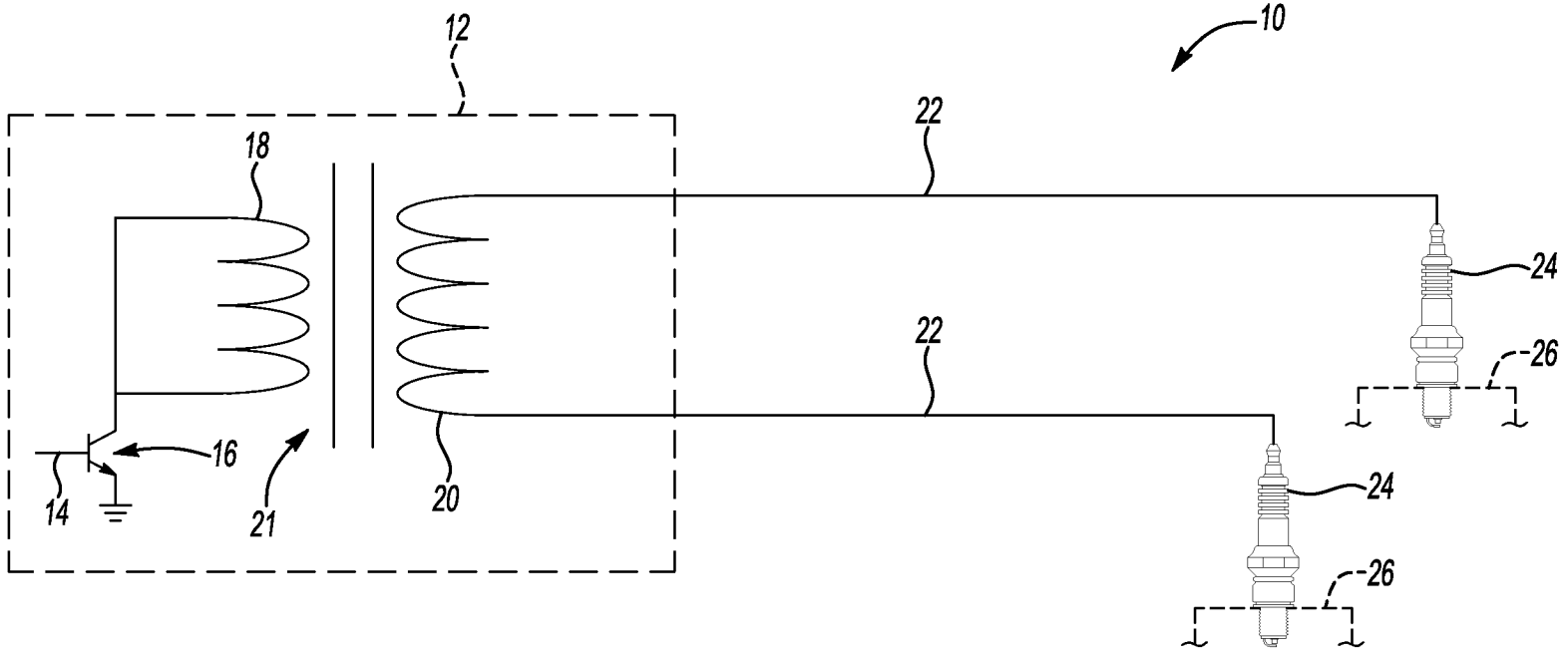
FIG. 1 is a schematic illustration of a vehicle ignition system with spark plugs having voltage relief features mounted in engine cylinders.

Referring to the drawings, wherein like reference numbers refer to like components, FIG. 1 shows a vehicle ignition system 10. The vehicle ignition system 10 includes an ignition coil assembly 12. Voltage is applied through a cable 14 from a battery (not shown) and flows through a grounded transistor 16 to a primary coil 18. This creates an electromagnetic field that induces current in a secondary coil 20. The coils 18, 20 are wrapped around an iron core 21 that is represented symbolically by two parallel lines, as is understood by those skilled in the art. The secondary coil 20 supplies the current through electronic components that distribute the current in an alternating fashion through spark plug wires 22 to spark plugs 24. Only two spark plug wires 22 and spark plugs 24 are shown; however, an engine to which the spark plugs 24 are mounted would have four or more spark plugs 24. The spark plugs 24 are mounted in the top of engine cylinders 26, shown only partially and in phantom. The vehicle ignition system 10 is a distributorless, secondary voltage distributor system, also referred to as a waste spark system, as will be well understood by those skilled in the art. Other types of vehicle ignition systems may be used within the scope of the claimed invention, such as a mechanical distributor, a coil/cylinder, or a high voltage, solid state switching system.

Figure 2:
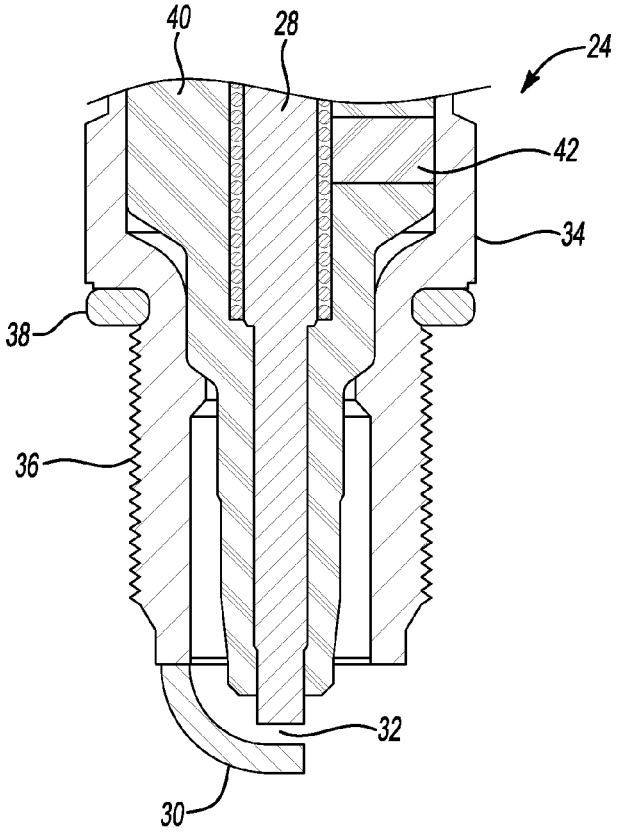
FIG. 2 is a schematic cross-sectional illustration in fragmentary view of one of the spark plugs of FIG. 1.

Referring to FIG. 2, one embodiment of the spark plug 24 for use in the ignition system 10 of FIG. 1 is illustrated. The spark plug 24 has a center electrode 28 that is connected with the spark plug wire 22 of FIG. 1. A counter electrode 30 is spaced from the center electrode 28 to define a gap 32 therebetween. The counter electrode 30 is grounded to a metal casing 34 on the exterior of the spark plug 24. The metal casing 34 has a threaded portion 36 for threading into an opening at the top of a cylinder 26 (see FIG. 1). A gasket 38 seals the spark plug 24 to the cylinder 26.

A ceramic insulator 40 surrounds the center electrode 28 to electrically isolate it from the rest of the spark plug 24, so that current will leave the center electrode 28 only via the gap 32, when a predetermined voltage is created between the center electrode 28 and the counter electrode 30, creating a spark at the gap 32. However, if oil, water or debris is situated in the gap 32, the voltage differential between the center electrode 28 and the counter electrode 30 will rise to levels beyond that intended to create a spark in the gap 32. The voltage differential may be beyond the dielectric strength of the ceramic insulator 40. In a typical spark plug, this could cause some of the ceramic insulator near the tip of the electrode 28 to chip, potentially damaging the cylinder 26 and increasing oil consumption.

The spark plug 24 is configured to prevent ceramic debris in the event of undesirably high voltage differential between the electrodes 28, 30. The spark plug 24 is equipped with a voltage relief feature 42 that controls the level at which excess voltage will be relieved from the spark plug 24, and also controls the location within the spark plug at which the voltage will be relieved. There are several alternative embodiments of voltage relief features 42 that will accomplish these goals. In one embodiment, the voltage relief feature 42 is a varistor that is designed to have a change in resistance at a predetermined voltage level to relieve excess voltage from the center electrode 28. As is well understood by those skilled in the art of electronics, a varistor is a voltage dependent resistor that shunts the current created by high voltage. At a range of voltages, the varistor has a high resistance, drawing only a relatively small current. At a predetermined higher voltage, however, the varistor will have a relatively low resistance, allowing significantly increased current to flow across the varistor 42 to ground at the metal casing 34, thus relieving the excess voltage of the center electrode 28. One type of known varistor that may be used is a metal oxide varistor. The varistor is designed to cause the resistance change at a predetermined voltage, such as 30 kV. The predetermined voltage is selected to be below the dielectric strength of the ceramic insulator 40, so that voltage is relieved prior to any breakdown and chipping of the insulator 40.

Alternatively, the voltage relief feature 42 may be a portion (e.g., a second portion) of the ceramic insulator 40 that is configured to have a dielectric strength lower than that of the remaining portion (e.g., a first portion) of the insulator 40. This may be accomplished by designing the voltage relief feature to have more air bubbles than the remainder of the ceramic insulator so that the voltage relief feature will be more conductive than the remainder of the insulator 40, thus relieving excessive voltage before any of the insulator 40 breaks down. Alternatively, the voltage relief feature 40 may be a portion of the insulator 40 that has more conductive material particles than the remainder of the insulator 40 (i.e., has a lower dielectric strength than the remainder of the insulator 40), such as by adding particles of a semiconductor, and hence will relieve voltage from the center electrode 28. In FIG. 2, it is apparent that the voltage relief feature 42 is located so that it is surrounded by the remainder of the ceramic insulator 40 and by the metal casing 34. Thus, voltage relief is controlled to a location within the spark plug 24 that will not allow ceramic debris into the cylinder 26 should the portion of the ceramic material forming the voltage relief feature 42 in this embodiment break down.

Figure 3:
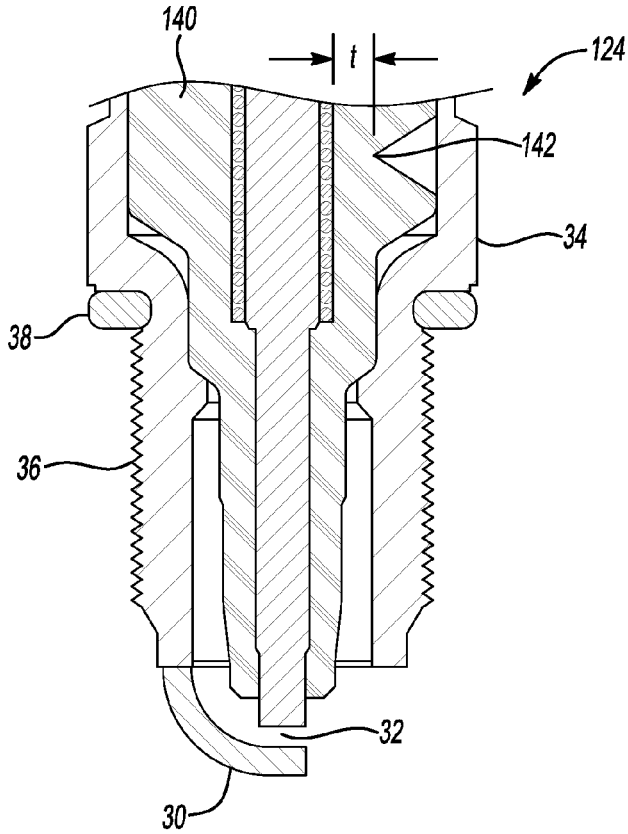
FIG. 3 is a schematic cross-sectional illustration in fragmentary view of an alternative embodiment of a spark plug for use in the ignition system of FIG. 1.
Figure 6:
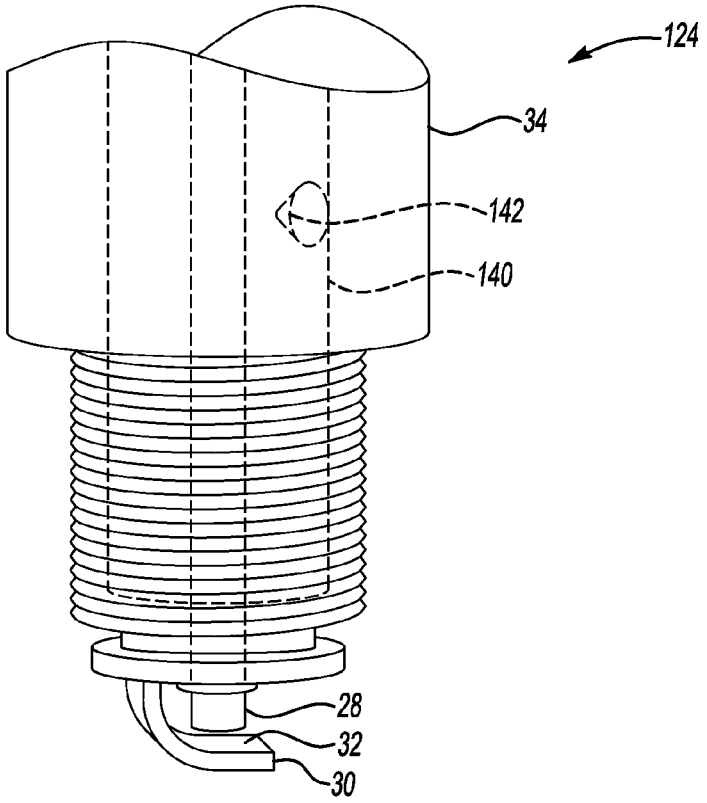
FIG. 6 is a schematic illustration in perspective view of the spark plug of FIG. 3.

Referring to FIG. 3, another embodiment of a voltage relief feature 142 within a spark plug 124 is illustrated. The spark plug 124 has many of the same components shown and described with respect to spark plug 24 of FIG. 2, and such components are referred to with the same reference numbers. The voltage relief feature 142 is a thinned portion of a ceramic insulator 140. The ceramic insulator 140 surrounds the center electrode 32. The thickness t of the thinned portion is configured in relation to the voltage gap 32 to breakdown at a predetermined voltage, thus preventing the ceramic insulator 140 from breaking at another location, such as near the electrode tip at the gap 32. Accordingly, ceramic debris cannot escape into the engine cylinder 26. As the spark plug gap 32 increases, the predetermined voltage and corresponding thickness t can increase without risk of ceramic debris. It is apparent in FIG. 6 that the voltage relief feature 142 is a small portion of the insulator, such that the insulator is narrowed only locally. The voltage relief feature 142 may be a plug of insulator material with a thinned portion inserted into the remainder of the insulator 140, or the insulator 140 may be a unitary component with the thinned portion machined, formed, or otherwise provided.

Figure 7:
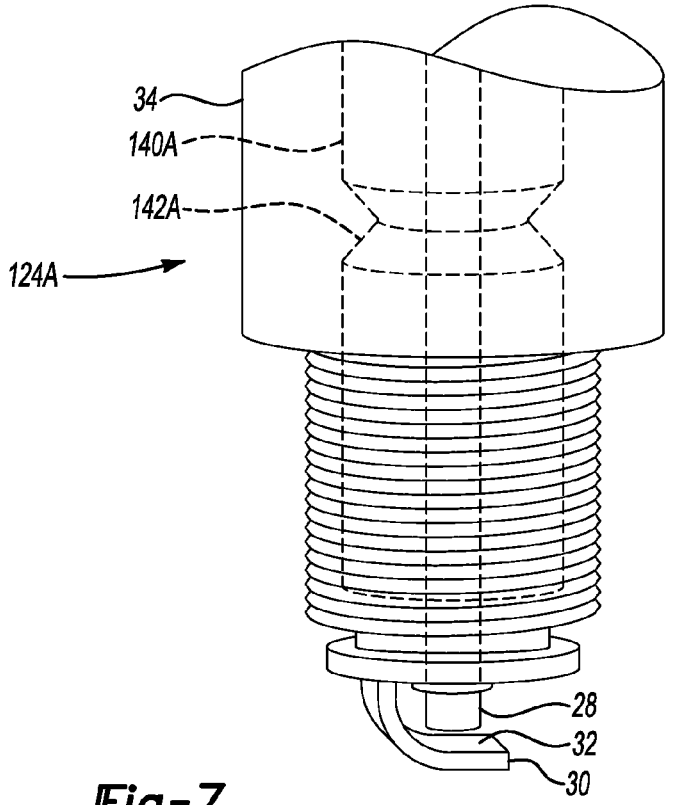
FIG. 7 is a schematic illustration in perspective view of an alternative embodiment of a spark plug for use in the ignition system of FIG. 1.

Alternatively, another embodiment of a spark plug 124A is shown in FIG. 7. Spark plug 124A has a voltage relief feature 142A that is a thinned portion circumscribing the insulator 140A. The insulator 140A will discharge voltage at a lower level than insulator 140, and will be mechanically weaker. Insulator 140 of FIG. 6 will have a mechanical strength close to that of an insulator without a voltage relief feature.

Figure 4:
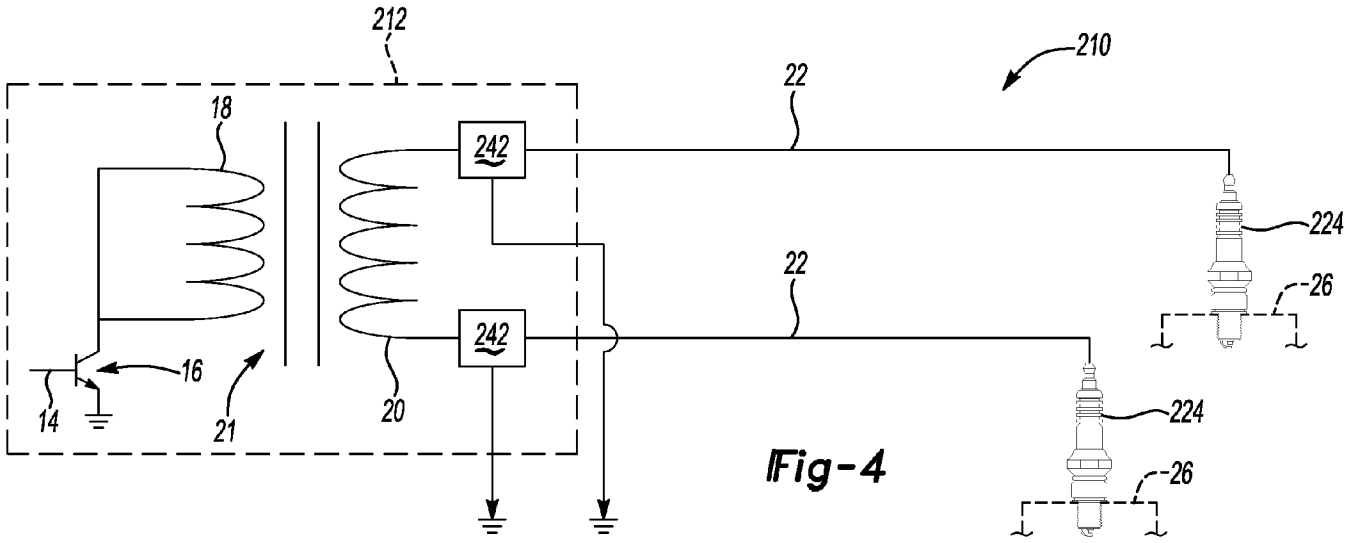
FIG. 4 is a schematic illustration of an alternative vehicle ignition system with a voltage relief feature in the ignition coil.

Referring to FIG. 4, another embodiment of a vehicle ignition system 210 is illustrated. The vehicle ignition system 210 has many of the same components as shown and described with respect to vehicle ignition system 10 of FIG. 1 and such components are referred to with the same reference numbers. The vehicle ignition system 210 uses conventional spark plugs 224, which are similar to spark plugs 24 of FIGS. 1 and 2 except that there is no voltage relief feature within the ceramic insulator. Instead, the voltage relief feature 242 is positioned in the ignition coil assembly 212. Specifically, dedicated voltage relief features in the form of varistors are operatively connected with the secondary coil 20 for controlling current fed to the respective spark plug wires 22 and spark plugs 224, preventing excess current that would otherwise be drawn by a large voltage differential in the spark plugs 224 caused by oil, water or debris in the respective spark plug gaps. The varistors may be any type of varistor, such as metal oxide varistors.

Figure 5:
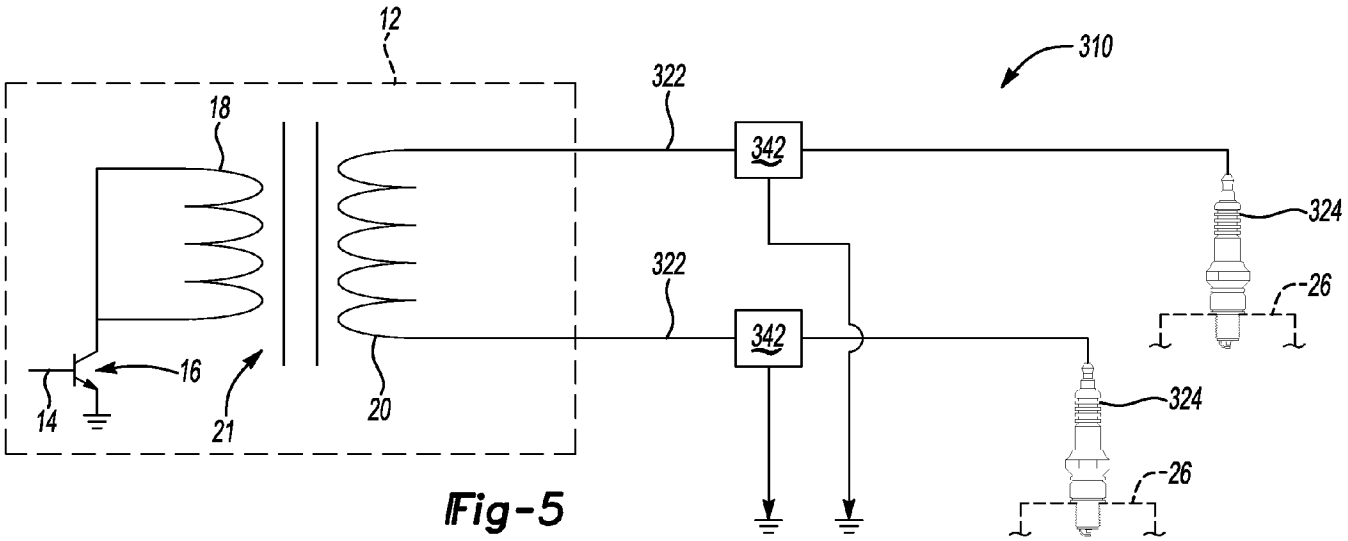
FIG. 5 is a schematic illustration of another alternative vehicle ignition system with voltage relief features in the spark plug wires.

Referring to FIG. 5, another embodiment of a vehicle ignition system 310 is illustrated. The vehicle ignition system 310 has many of the same components as shown and described with respect to vehicle ignition system 10 of FIG. 1 and such components are referred to with the same reference numbers. The vehicle ignition system 310 uses conventional spark plugs 324, which are similar to spark plugs 24 of FIGS. 1 and 2 except that there is no voltage relief feature within the ceramic insulator. Instead, the voltage relief feature 342 is positioned in the ignition coil assembly 12. Specifically, dedicated voltage relief features in the form of varistors are operatively connected with the spark plug wires 322 for controlling current fed to the respective spark plugs 324, preventing excess current that would otherwise be drawn by a large voltage differential in the spark plugs 324 caused by oil, water or debris in the respective spark plug gaps. The varistors may be any type of varistor, such as metal oxide varistors.

While the best modes for carrying out the invention have been described in detail, those familiar with the art to which this invention relates will recognize various alternative designs and embodiments for practicing the invention within the scope of the appended claims.

The invention claimed is:

1. A vehicle ignition system comprising:

a spark plug having:

an electrode;

an insulator around the electrode;

a voltage relief feature operatively connected with the electrode and operable to discharge current from the electrode at a predetermined voltage;

wherein the voltage relief feature is positioned within the insulator;

wherein the insulator is located above and beneath the voltage relief feature with respect to a longitudinal direction of the electrode; and wherein the insulator is characterized by ceramic properties of a first dielectric strength and the voltage relief feature is characterized by ceramic properties of a second dielectric strength lower than the first dielectric strength.

2. The vehicle ignition system of claim 1, further comprising:

a metal casing surrounding the insulator and the voltage relief feature;

a counter electrode extending from the metal casing to establish a gap between the electrode and the counter electrode; and wherein the voltage relief feature extends radially through the insulator to the metal casing.

3. A vehicle ignition system comprising:

a spark plug having an electrode;

a ceramic insulator surrounding the electrode along a length of the electrode;

a voltage relief feature within the ceramic insulator operable to discharge current from the electrode at a predetermined voltage; wherein the ceramic insulator is located above and beneath the voltage relief feature with respect to a longitudinal direction of the electrode;

wherein the insulator is characterized by ceramic properties of a first dielectric strength and the voltage relief feature is characterized by ceramic properties of a second dielectric strength lower than the first dielectric strength;

a metal casing surrounding the ceramic insulator and the voltage relief feature;

a counter electrode extending from the metal casing to establish a gap between the electrode and the counter electrode;

wherein the voltage relief feature extends radially through the ceramic insulator to the metal casing; and wherein the voltage relief feature only partially radially surrounds the electrode.

4. A spark plug comprising:

a first electrode;

an insulator surrounding the first electrode along a length of the electrode;

a second electrode spaced from the first electrode to define a gap; and a voltage relief feature within the insulator operable to discharge current from the electrode at a predetermined voltage when an object is in the gap; wherein the insulator is located above and beneath the voltage relief feature with respect to a longitudinal direction of the first electrode;

wherein the insulator is characterized by ceramic properties of a first dielectric strength and the voltage relief feature is characterized by ceramic properties of a second dielectric strength lower than the first dielectric strength;

a metal casing surrounding the insulator and the voltage relief feature and having a threaded portion;

wherein the second electrode extends from the metal casing; and wherein the voltage relief feature extends radially through the insulator to the metal casing.

5. The spark plug of claim 4 wherein the voltage relief feature only partially radially surrounds the first electrode.

* * * * *